United States Patent [19]

Lipinski

[11] 4,067,347

[45] Jan. 10, 1978

[54] SOLAR HEATED SHELTER WITH MOVEABLE SECONDARY ROOF

[76] Inventor: Vincent B. Lipinski, P.O. Box 41, Chaska, Minn. 55318

[21] Appl. No.: 710,099

[22] Filed: July 30, 1976

[51] Int. Cl.[2] ..... A45F 1/16

[52] U.S. Cl. ..... 135/4 R; 47/17; 52/66; 135/14 V

[58] Field of Search ..... 135/1 R, 14 V, 4 R; 52/63, 66; 47/17

[56] References Cited

U.S. PATENT DOCUMENTS

| | | | |
|---|---|---|---|
| 758,033 | 4/1904 | Holmes | 135/14 V |
| 3,598,133 | 8/1971 | Abert et al. | 135/1 R |
| 3,670,747 | 6/1972 | Pohl et al. | 135/1 R |
| 3,800,814 | 4/1974 | Hibbert | 135/1 R |
| 3,970,096 | 7/1976 | Nicolai | 135/14 V |
| 3,971,395 | 7/1976 | Lipinski | 135/4 R X |

*Primary Examiner*—Werner H. Schroeder
*Assistant Examiner*—Conrad L. Berman
*Attorney, Agent, or Firm*—Williamson, Bains, Moore & Hansen

[57] ABSTRACT

A portable solar heated shelter comprising at least one fixed roof layer and a second roof layer which can be selectively deployed to vary the thermal characteristics of the shelter. The shelter preferably comprises a rigid frame on which first and second end walls are preferably pivotally mounted. The end walls are preferably foldable between a vertically upright operative position and a generally horizontal, lowered storage position, and when deployed support the roof layers to define the enclosure. The second roof layer is adapted to be unwound from a storage spool and drawn into a take-up spool, passing over the first roof layer, by a cranking action. The second roof layer preferably comprises a first sunshade portion and a series connected heat insulative portion of opaque material which may be selectively deployed to control the thermal characteristics of the enclosure.

12 Claims, 7 Drawing Figures

SOLAR HEATED SHELTER WITH MOVEABLE SECONDARY ROOF

BACKGROUND OF THE INVENTION

This invention relates to portable shelters. More particularly, the instant invention relates to a tent-like enclosure which includes an air insulative barrier adapted for thermally insulating the apparatus.

In the prior art a variety of collapsible shelters are known. Many of these shelters include one or more walls which may be selectively deployed in order to erect a small enclosure where desired by a fisherman or outdoorsman, for example. Most prior art collapsible enclosures or tent structures include a support frame which may be folded or selectively manipulated to form the desired supportive frame structure and an outer sheath such as tarpaulin or the like to provide an insulative layer. One example of a prior art shelter enclosure will be seen in my U.S. Pat. No. 3,971,395, issued July 27, 1976.

Prior art portable, and collapsible enclosures are shown in U.S. Pat. No. 2,804,083, issued to A. Wieber on Aug. 27, 1957; U.S. Pat. No. 2,301,089, issued Nov. 3, 1942 to R. Stevens; and U.S. Pat. No. 3,175,857, issued to R. Lewis on Mar. 30, 1965. Examples of enclosures adapted to be used for ice fishing include U.S. Pat. No. 2,473,076, issued to C. Scheibner on June 14, 1949; U.S. Pat. No. 2,891,562, issued to A. Kruczynski on June 23, 1959; U.S. Pat. No. 3,352,313, issued to M. Kroening on Nov. 14, 1976; U.S. Pat. No. 2,546,730, issued to F. Dickerson on Mar. 27, 1951; U.S. Pat. No. 2,546,588, issued to J. Ellis on Mar. 27, 1951; U.S. Pat. No. 2,632,454, issued Mar. 24, 1953 to C. Skogen; and U.S. Pat. No. 3,157,185, issued Nov. 17, 1964 to J. Schoenike. A collapsible study enclosure structure is disclosed in U.S. Pat. No. 3,538,976, issued to C. Gilbert et al. A method of fabricating a solar still is disclosed in U.S. Pat. No. 3,006,818, issued Oct. 31, 1961 to R. Lappala et al.

It is believed that the following references are perhaps the most pertinent to the instant invention: U.S. Pat. No. 3,244,186, issued Apr. 5, 1966 to T. Thomason et al. for a solar heated tent; U.S. Pat. No. 3,052,249, issued to S. Seaman et al. Sep. 4, 1962 for a collapsible tent structure; U.S. Pat. No. 2,918,023, issued Dec. 22, 1959 to B. Bettcher for a thermal insulating light-admitting device; and U.S. Pat. No. 2,996,729, issued Aug. 22, 1961 to I. Bailey for a swimming pool which includes a plurality of roof layers for defining thermally insulative air pockets.

No known prior art however, solves the problem of providing an enclosure which may be moved about very easily by the operator, and which also is well adapted to solar heating so as to be easily adjusted between solar heat receiving configuration and heat retaining configuration.

SUMMARY OF THE INVENTION

The instant invention comprises a portable enclosure for camping, plant growing, storage or the like which may be quickly and easily transported by the operator and quickly erected upon reaching the desired site. To this effect, the apparatus comprises a generally planar frame defining a flat floor surface and on which first and second spaced apart end walls are mounted. In one form of the invention, the end walls may be pivoted between the vertically upright positions defining the enclosure to lower horizontal storage positions parallel to the floor. A plurality of elongated reinforcement rods and cooperating cables are preferably provided to selectively secure the walls in an upright position. Importantly, the roof structure preferably comprises a first inner flexible layer disposed between the end walls and a second layer which may be selectively deployed over the first layer depending upon the thermal characteristics desired from the enclosure. A third selectively removable roof layer extends between the end walls, and is spaced outwardly from the first layer to define a heat insulative chamber between first and third roof layers and into which the second roof layer may be deployed.

The selectively deployable second roof layer is normally wound in a storage spool, which is adapted to be attached to the frame and which may be unwound where desired to output the second layer. A cooperating take-up spool is linked to the storage spool so that by cranking the take-up spool the second roof layer will be deployed over the enclosure, being transferred from the storage spool to the take-up spool. To the latter effect means are provided to link the two spools. Importantly, the second roof layer preferably comprises a first sunshade portion for deployment when desired to shade the enclosure from direct sunlight and a second portion of heat insulative material for deployment when desired to confine heat within the enclosure interior. Thus, by selectively storing or deploying one or the other of the portions of the second roof layer, the enclosure inhabitant may vary the thermal characteristics of the apparatus.

Thus, an object of this invention is to provide a portable enclosure adapted for use in either hot or cold environmental situations. More particularly, an important object of this invention is to provide an enclosure of the character described with a roof section which may be selectively deployed to either reject or admit heat or light depending upon preselected conditions.

Still another object of this invention is to provide a portable enclosure of the character described which can be quickly and easily erected or disassembled by the user.

A still further object of this invention is to provide a portable, collapsible enclosure of the character described which, once erected, will provide a very sturdy and reliable temporary dwelling place suited for a wide variety of outdoor uses such as camping, storage, and use as a portable greenhouse. Use of the shelter permits plant raising during all but the coldest months with only minimal extra heating being needed during night hours.

Yet another object of this invention is to provide an enclosure of the character described which is ideally suited for use in ice fishing or other cold weather activities. It is a feature of this invention that when deployed in daylight, heat and light from the sun may be readily admitted through the roof structure when the second roof layer is in storage position on the storage spool. With the approach of nightfall the insulative portion of the second roof layer may be drawn into place to retain heat within the enclosure.

These and other objects and advantages of this invention along with features of novelty appurtenant thereto will appear or become apparent in the course of the following detailed description.

BRIEF DESCRIPTION OF THE DRAWINGS

In the following drawings which form a part of the specification and are to be construed in conjunction therewith, and in which like reference numerals have been employed throughout to indicate like parts in the various views.

DETAILED DESCRIPTION OF THE DRAWINGS

Figure 1:
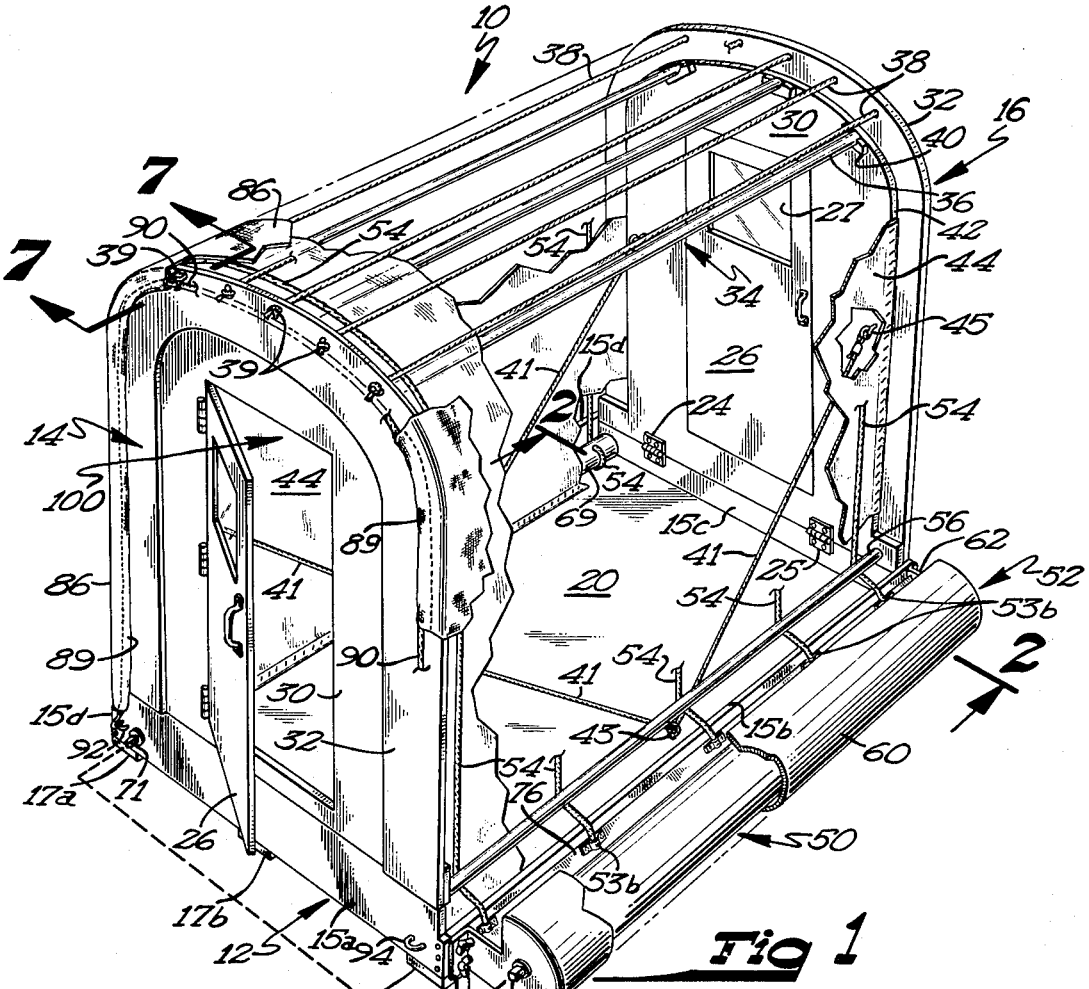
FIG. 1 is a perspective view of a solar heated shelter constructed in accordance with the teachings of this invention, and with parts thereof broken away or shown in section for clarity.
Figure 6:
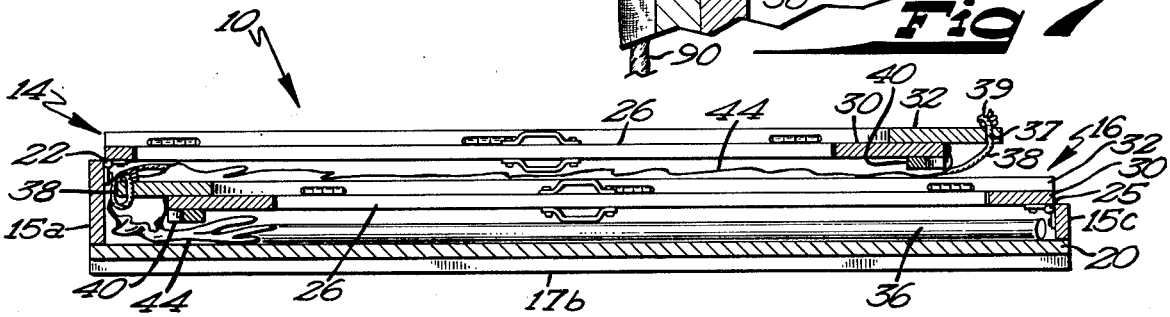
FIG. 6 is a side, sectional view of the shelter in a collapsed or folded transportable storage position.

In FIG. 1 there is shown a solar heated shelter 10 which includes a generally horizontal rectangular, planar frame 12 adapted to be disposed upon a supporting surface such as ground or the like. Frame 12 supports a pair of spaced apart, generally vertically oriented upright end walls 14 and 16. Frame 12 comprises a plurality of elongated, right-angled structural members 15*a* through 15*d* which are rigidly secured in the form of a rectangle and which surround a supportive floor 20 which comprises a sheet of plywood or the like. As best seen in FIG. 6, the foldable end wall 14 is preferably pivotally coupled to frame portion 15*a* by a hinge 22. The oppositely disposed end wall 16 is preferably pivotally coupled to the frame member 15*c* through a pair of hinges 24 (FIG. 1) and 25 which enable end wall 16 to be folded into the lower, storage position illustrated in FIG. 6 wherein it overlies and is substantially parallel with floor 20. It will be appreciated that since frame side portion 15*c* is preferably of lesser height than frame portion 15*a*, end wall 14 will overlie end wall 16 when the end walls are placed in the storage position. As illustrated, each end wall 14 and 16 preferably includes a hinged access door member 26 with window 27 to selectively permit access to the enclosure interior. Elongated skids 17*a*–17*c* extending underneath frame 12 and fastened to floor 20 support the shelter and offset it from the ground to help keep floor 20 dry.

Figure 7:
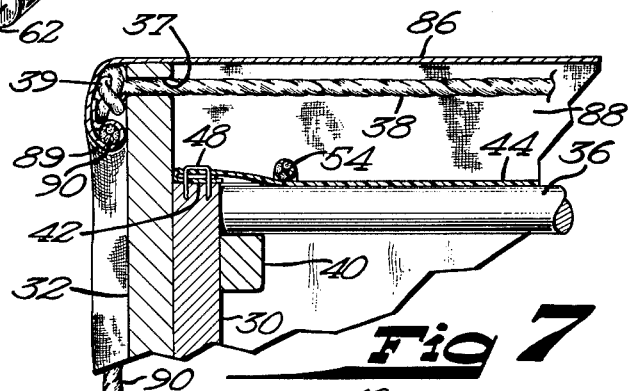
FIG. 7 is an enlarged, sectional view taken through line 7—7 in FIG. 1, with parts thereof broken away for clarity.

It will be apparent that each of the end walls are preferably bell-shaped or of generally inverted U-shaped profile. Each end wall preferably comprises an inner (as viewed in FIG. 1) U-shaped portion 30 in which one of the access doors 26 may be defined and a circumferentially extending, outer U-shaped peripheral portion 32 which is offset somewhat from the lower frame 12. The end walls 14 and 16 are preferably supported in the vertically upright, operative position illustrated in FIG. 1 by wall support means 34 which preferably comprises a plurality of rigid, elongated support rods 36. In addition, reinforcement cables 41 are anchored to each end wall at eyelets 45 and extend to screw eyes 43 which are attached to floor 20. Rods 36 extend between the inner U-shaped portions 30 of the end walls and are removably anchored to brackets 40 to provide support when desired to maintain the structure in the upright, vertically operative position. As best seen in FIG. 7, each rod 36 is maintained in position at the upper periphery of the inner end wall portions 30 by a support bracket 40 which prevents the rod from falling. A plurality of cables or ropes 38 are disposed between the two end walls 14 and 16 and received through orifices 37 defined in the peripheral portion 32. It will be appreciated that the ropes or cables 38 are each provided with an anchor knot 39 to prevent them from axially withdrawing from the wall orifice 37 in which they are received. In this manner the ropes aid maintaining the walls in an upright position while permitting the selective folding of same when desired to transport or move the shelter. When shelter 10 is transported in collapsed position (FIG. 6), ropes 38 will simply be loosely disposed between adjacent end walls 14 and 16. Ropes 38 play a major role in supporting the outermost third roof layer 86 which will be described further hereafter and provide needed support for the layer 86 when the shelter is subjected to wind or snow accumulation. After removing rods 36 from their operative positions they may be stored in a convenient spot underlying the end walls 14 and 16 on top of the lower floor 20.

The outer peripheral edge 42 of each inner end wall portion 30 provides a mounting surface for a first, flexible preferably weather-resistant roof layer 44 which extends between end walls 14 and 16 over rods 36 to define an enclosure 100. The first weather-resistant layer 44 is preferably in the form of a translucent or transparent weather-resistant plastic tarpaulin, canvas, or the like and it, of course, defines an integral inner roof and integral side walls. It will be appreciated that the first roof layer 44 will conveniently fold inwardly when necessary to store or transport the shelter, as illustrated in FIG. 6. The inner or first roof layer 44 will overlie and be supported by support rods 36 (FIG. 7), and it is secured to outer rim 42 of inner end wall portion 30 by a plurality of staples 48.

Figures 2, 3, 4, 5:
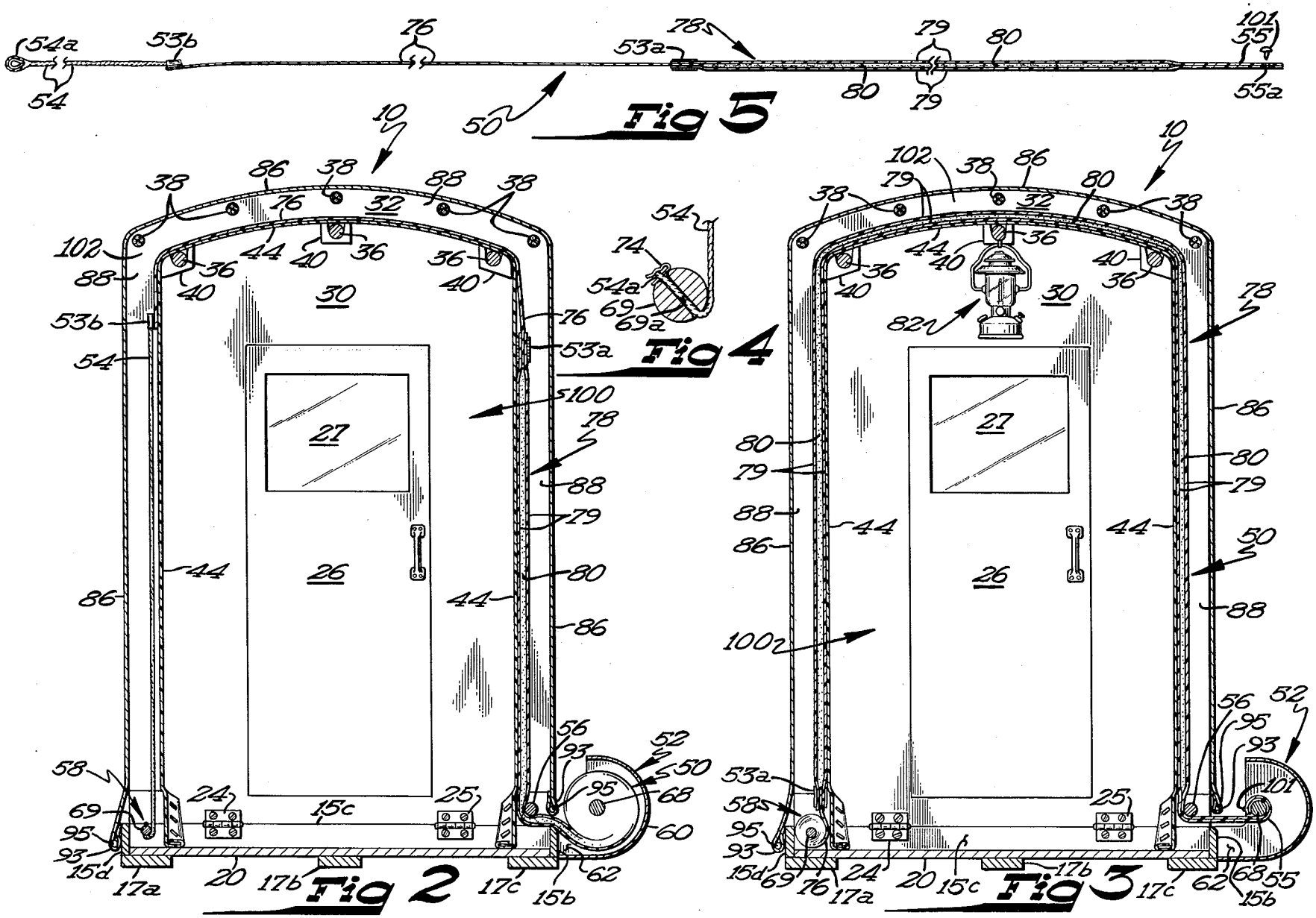
FIG. 2 is a front, sectional view of the shelter showing a second roof layer in a deployed position with a sunshade portion disposed over the top of the enclosure and taken along cutting plane 2—2 of FIG. 1.
FIG. 3 is a front, sectional view of the shelter similar to FIG. 2, but showing the second roof layer in a deployed position in which heat insulative material is disposed over the enclosure.
FIG. 4 is an enlarged, sectional view of the takeup spool axle illustrating the draw system anchored therethrough.
FIG. 5 is an enlarged, end view of the second roof layer.

A second, flexible roof layer 50 is preferably stored within a storage spool 52 which is attached to the frame 12 and oriented generally parallel with respect to frame side 15*b*. Roof layer 50 may be deployed in a position immediately overlying the first roof layer 44 by a plurality of linkage cables 54 which pass under a supportive guiderod 56 (extending between end walls 14 and 16) and over the upper guide rods 36 and first roof layer 44, and thereafter into a take-up spool 58 disposed adjacent frame 12, parallel to and opposite storage spool 52. As best seen in FIGS. 2 and 3 spool 52 comprises an elongated, generally cylindrical outer housing 60 including a pair of end plates 62 which have foot portions 63 thereof anchored to frame 12 by wing nuts received by a pair of studs 64. The storage spool 50 also comprises an interiorly disposed, rotatable axle 68 which extends between end plates 62 and is journaled for rotation therewith. As seen in FIG. 1 the axle 68 includes a fitting 70 which may be adjusted to rotate the axle as desired by the operator. It will be appreciated that the second roof layer 50 is normally coiled about axle 68 within spool 52 when the apparatus is in the storage or folded position.

Take-up spool 58 comprises an interiorly disposed, elongated, rotatable axle 69 on which the second roof layer 50 may be selectively wound. Axle 69 is jounaled for rotation and received between frame ends 15*a* and 15*c*, and it includes an external fitting 71 which may be manipulated as by a crank, rachet wrench or other crank apparatus 72 (FIG. 1) when desired to deploy the second roof layer. Referring now to FIGS. 4 and 5, take-up cables 54 are received by axles 69. The cable 54 has been secured through passageway 69*a* by a clip 74 which penetrates a cable loop 54*a* to fasten the cables to axle 69. The second roof layer 50 is secured to storage spool axle 68 by a stud or fastener 101 which extends through aperture 55*a* of the end section 55 of layer 50 and into axle 68.

Thus when it is desired to deploy the second roof layer 50 the enclosure inhabitant need merely position and secure cables 54, and wind take-up spool 58, thereby pulling the second roof layer out of storage spool 52 into deployment over the enclosure 100. It will be appreciated that as the second roof layer 50 is deployed, it will overlie and loosely contact the first roof layer 44 which is permanently afixed between the end walls 14 and 16.

Referring now to FIG. 5, the second roof layer preferably comprises a first portion 76 which is in turn connected in series via joint 53*a* to a second portion 78. Draw cables 54 are secured at spaced apart intervals to segment 76 by crimps 53*b*. Segment 78 is preferably in the form of a pair of spaced apart, clear plastic layers 79 between which is sandwiched a heat insulation layer 80 of thermal insulative material such as fiberglass or the like. An aperture 55*a* of segment 78 comprising adjacent plastic layers 80 is adapted to be anchored to axle 68 as described earlier. The first segment 76 may comprise black or opaque plastic, for example, so that when deployed it will function as a sunshade or sunscreen. Of course, segment 76 may comprise reflective foil, translucent material or other material depending upon the application to which the shelter is put.

By selectively deploying the second roof layer 50 until sunshade segment 76, for example, is positioned over the top of the enclosure (FIG. 2), light and heat will be screened from the enclosure. By simply rotating take-up spool 58 a further degree, it will be appreciated that the sunshade or sunscreen portion 76 will be drawn into the take-up spool 58 for temporary storage, and portion 78 will be positioned over the enclosure 100 to retain heat therein. By adding a lantern 82 or small heater the temperature within the shelter can be kept easily above freezing and plants may be grown even during the cold winter months. Heat produced by the latern in retained within the enclosure 100 by the dead air chamber 102 and insulative portion 78. Thus roof segment 78 facilitates retention of solar heat or artificial heat in the enclosure, while segment 76 can be deployed where desired to screen or cool the enclosure. The thermal characteristics of the shelter 10 may thus be varied by simply deploying the desired segment of second roof layer 50 as illustrated in FIG. 2 for a sunscreening effect, for example, or as illustrated in FIG. 3 to retain accumulated solar heat in the shelter or to retain heat generated by the lantern 82 or heater during night hours.

In a preferred form, the shelter also comprises a third roof layer 86 which extends between and overlies end walls 14 and 16. This third roof layer 86 is preferably comprised of translucent plastic, and defines a dead air chamber or pocket 88 (FIGS. 2 and 3) between itself and the lower roof layers 44 and 50. Each end of the third outermost roof layer 86 comprises a hem portion 89 thereof through which a fastening rope or cable 90 extends, being fastened at opposite sides of frame member 15*a* to eyelets 92 and 94 respectively. It will be appreciated that as support cable 90 is tightened, the hem 89 will be drawn into contact with the peripheral end wall portions 32, being frictionally maintained in position by contact with the knots 39 in upper support cables 38. Each knot 39 is positioned immediately adjacent the hem support rope 90. Thus, through the construction disclosed, it will be apparent that the outermost roof layer 86 which is further supported on cables 38 will be secured in position outside of the enclosure against even strong winds by the frictional engagement of the hem 89 and the cable support knots 39. It will also be appreciated that the dead air pocket 88 defined between the two innermost roof layers and the outer roof layer 86 additionally thermally insulates the enclosure 100. Unlike inner roof layer 44, however, the third or outermost roof layer 86 must be removed from the enclosure before transporting same between locations.

The outer roof layer 86 has lateral hems 93, each of which has a weighted rod or bar 95 therein to keep the lateral hems in the shown positions of FIGS. 2 and 3. The deployable second roof layer 50 slips from the spool 52 over the member 15*b* and under lateral hem 93 as it moves toward guide bar 56.

Thus when a temporary enclosure is needed at a particular site, for example, the enclosure 10 is ideally suited. It will withstand strong winds and reasonably extreme temperature conditions, and it may be quickly transported and easily erected. The enclosure 10 may very advantageously be employed for ice fishing, because it provides an extremely comfortable enclosure for the fisherman. Of course, in the latter case one or more holes will be defined within the floor surface 20. The shelter may be used as a greenhouse or even as a portable garage when made larger and with appropriate doors. The enclosure may also be placed upon skiis, pontoons or the like. Where desired it may be placed in the bed of a pickup truck either in the folded, storage position shown in FIG. 6 or the fully erected position shown in FIGS. 1 through 3.

From the foregoing, it will be seen that this invention is one well adapted to obtain all the ends and objects herein set forth, together with other advantages which are obvious and which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A solar energy heated shelter comprising:

a rigid, substantially horizontal frame adapted to be disposed upon a supporting surface, said frame defining a generally flat floor surface;

a first upright, generally vertical end wall coupled to said frame;

a second upright, generally vertical end wall spaced apart from said first wall and coupled to said frame;

wall support means extending between said first and second end walls for maintaining said first and second walls in an upright generally vertical position;

a first flexible weather-resistant roof layer extending between and fixed to said first and second end walls, said first roof layer forming roof and side walls, and thereby cooperating with said frame and said first and second end walls to define an enclosure;

a second flexible roof layer moveably mounted relative to said first roof layer for movement between a storage position, wherein said second roof layer is clear of said first roof layer to permit solar energy to be incident on said first roof layer, and a deployed position, wherein said second roof layer at least partially covers said first roof layer to intercept solar energy otherwise incident on said first roof layer and to better contain within said enclosure solar energy already absorbed by the enclosure;

storage spool means carried by said frame for storing said second roof layer when in storage position and for selectively outputting said second roof layer in response to unwinding of said spool means to move said second roof layer to deployed position;

take up spool means revolvably attached to said frame opposite said storage spool means for cooperating with said storage spool means to draw said second roof layer into deployed position over said enclosure; and door means defined in at least one of said first and second end walls for selectively enabling access to said enclosure.

2. The combination as defined in claim 1 wherein:

said first end wall is swingably mounted to said frame for movement between an upright erected position and a storage position overlying said floor surface;

said second end wall is swingably mounted to said frame for movement between an upright erected position and a storage position overlying said first end wall when said first end wall is in said storage position; and said first roof layer is adapted to be foldably stored and confined between said first and second end walls when said end walls are in storage positions.

3. The combination as defined in claim 2 wherein said wall support means comprises:

a plurality of cables extending between said first and second end walls, permitting said end walls to be swung from storage positions to erected positions and preventing further swinging of said walls beyond erected positions; and a plurality of elongated rods removably attached between said first and second end walls to selectively rigidly maintain said walls in upright erected positions.

4. The combination as defined in claim 3 wherein said second roof layer contacts said first roof layer and is supported by same when in a deployed position; and said first and second end walls each include an integral mounting surface for supporting said first roof layer.

5. The combination as defined in claim 1 wherein said enclosure includes a third roof layer extending between said first and second end walls and spaced apart from said first and second roof layers a preselected distance to thereby define a thermally insulative air layer between itself and said first and second roof layers.

6. The combination as defined in claim 5 and further including a plurality of cables extending between said first and second end walls and including knots at each outer end of said cables selectively anchored through predefined orifices provided in an outer periphery of each of said first and second end walls, thereby anchoring said cables within said walls to secure same in a supportive position; and said third roof layer comprises a first hem portion abutting said first end wall and a second hem portion abutting said second end wall, a first cable disposed through said first hem to tightly secure said third roof layer to said first end wall and a second cable disposed through said second hem portion to secure said third layer against said second end wall, said first and second support hems closely abutting said support cable knots and being rigidly secured through frictional engagement therewith.

7. The combination as defined in claim 5 wherein said second roof layer comprises a first selectively deployable sunshade portion for substantially reducing the passage of sunlight therethrough and a second selectively deployable insulative portion comprised of generally opaque heat insulating material for preventing the outward escape of heat from said enclosure, thereby selectively controlling the thermal characteristics of said enclosure.

8. The combination as defined in claim 7 wherein:

said first end wall is swingably mounted to said frame for movement between an upright erected position and a storage position overlying said floor surface;

said second end wall is swingably mounted to said frame for movement between an upright erected position and a storage position parallel to said floor and overlying said first end wall when said first end wall is said storage position; and said first roof layer is adapted to be foldably stored and confined between said first and second end walls when said end walls are in storage positions.

9. The combination as defined in claim 8 wherein said wall support means comprises:

a plurality of cables extending between said first and second end walls, permitting said end walls to be swung from lowered storage positions to erected positions and preventing further swinging of said walls beyond erected positions; and a plurality of elongated rods removably attached between said first and second end walls to selectively rigidly maintain said walls in an upright erected position.

10. The combination as defined in claim 1 wherein said second roof layer comprises a first selectively deployable sunshade portion for substantially reducing the passage of sunlight therethrough and a second selectively deployable insulative portion comprised of generally opaque heat insulting material for preventing the outward escape of heat from said enclosure thereby selectively controlling the thermal characteristics of said enclosure.

11. The combination as defined in claim 10 wherein said storage spool means comprises a housing secured to said frame; an elongated axle member rotatably disposed generally concentrically interiorly of said housing, and drive means releasably attached to said axle and adjustable externally of said housing to facilitate the selective winding or unwinding of said second roof layer.

12. The combination as defined in claim 11 wherein said first and second end walls are of generally bell-shaped configuration, and include an outer peripheral portion and a lower peripheral mounting surface contacted by said first roof layer.

* * * * *